US009016369B2

(12) United States Patent
Atkinson et al.

(10) Patent No.: US 9,016,369 B2
(45) Date of Patent: Apr. 28, 2015

(54) DOWNHOLE PISTON ACCUMULATOR SYSTEM

(75) Inventors: Robert Atkinson, Richmond, TX (US); Nathan Harder, Magnolia, TX (US); Michael T. Pelletier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 150 days.

(21) Appl. No.: 13/821,762

(22) PCT Filed: Sep. 8, 2010

(86) PCT No.: PCT/US2010/048100

§ 371 (c)(1), (2), (4) Date: Mar. 8, 2013

(87) PCT Pub. No.: WO2012/033486

PCT Pub. Date: Mar. 15, 2012

(65) Prior Publication Data

US 2013/0168088 A1 Jul. 4, 2013

(51) Int. Cl.
*E21B 49/10* (2006.01)
*E21B 49/08* (2006.01)

(52) U.S. Cl.
CPC ..... *E21B 49/081* (2013.01); *E21B 49/10* (2013.01)

(58) Field of Classification Search
USPC ..... 166/264, 100; 175/59
See application file for complete search history.

(56) References Cited

U.S. PATENT DOCUMENTS

| | | | | |
|---|---|---|---|---|
| 2,520,306 | A | 8/1950 | Detweiler | |
| 4,207,802 | A * | 6/1980 | Homuth | 91/405 |
| 4,674,754 | A | 6/1987 | Lair et al. | |
| 5,328,177 | A | 7/1994 | Lair et al. | |
| 5,531,513 | A * | 7/1996 | Tackett | 303/84.2 |
| 7,140,436 | B2 | 11/2006 | Grant et al. | |

OTHER PUBLICATIONS

International Application No. PCT/US2010/048100 Search Report and Written Opinion dated May 24, 2011.

* cited by examiner

*Primary Examiner* — William P Neuder

(57) ABSTRACT

A downhole piston accumulator system is disclosed, such as for a formation tester. The soft piston of the system is designed to withstand high pressure downhole fluids in small volume cylinders, the fluid being collected for optical fluid identification or other analyses. The temperature range of the fluid may vary widely, which can be accommodated by the soft piston. Sealing components on the soft piston include additional materials for sealing the soft piston and otherwise helping to accommodate the wide ranging pressures and temperatures. The piston container or cylinder is designed to properly capture the piston and accommodate piston movement. The piston accumulator system allows an outer or exterior position sensor to detect piston movement, such as by a magnetic sensor.

20 Claims, 10 Drawing Sheets

1
2
3
4
9
8
15
5
6
10
11
13
7

DOWNHOLE PISTON ACCUMULATOR SYSTEM

This application is the U.S. National Stage under 35 U.S.C. §371 of International Patent Application No. PCT/US2010/048100 filed Sep. 8, 2010, entitled "Downhole Piston Accumulator System."

STATEMENT REGARDING FEDERALLY SPONSORED RESEARCH AND DEVELOPMENT

Not applicable.

BACKGROUND

During the drilling and completion of oil and gas wells, it may be necessary to engage in ancillary operations, such as evaluating the production capabilities of formations intersected by the wellbore. For example, after a well or well interval has been drilled, zones of interest are often tested to determine various formation properties or formation fluid characteristics, or to gather fluid samples. Examples of information obtained include fluid identification, fluid type, fluid quality, formation permeability, formation temperature, formation pressure, bubblepoint and formation pressure gradient. These tests are performed in order to determine whether commercial exploitation of the intersected formations is viable and how to optimize production. The acquisition of accurate data from the wellbore is critical to the optimization of hydrocarbon wells. This wellbore data can be used to determine the location and quality of hydrocarbon reserves, whether the reserves can be produced through the wellbore, and for well control during drilling operations.

A downhole tool is used to acquire and test a sample of fluid from the formation. Formation testing tools may be used in conjunction with wireline logging operations or as a component of a logging-while-drilling (LWD) or measurement-while-drilling (MWD) package. In wireline logging operations, the drill string is removed from the wellbore and measurement tools are lowered into the wellbore using a heavy cable (wireline) that includes wires for providing power and control from the surface. In LWD and MWD operations, the measurement tools are integrated into the drill string and are ordinarily powered by batteries and controlled by either on-board or remote control systems. In these systems, a probe assembly may be used for engaging the borehole wall and acquiring the formation fluid samples.

With LWD/MWD testers, the testing equipment is subject to harsh conditions in the wellbore during the drilling process that can damage and degrade the formation testing equipment before and during the testing process. These harsh conditions include vibration and torque from the drill bit, exposure to drilling mud, drilled cuttings, and formation fluids, hydraulic forces of the circulating drilling mud, high downhole temperatures, and scraping of the formation testing equipment against the sides of the wellbore. Sensitive electronics, sensors and even mechanical components must be robust enough to withstand the pressures and temperatures, and especially the extreme vibration and shock conditions of the drilling environment, yet maintain accuracy, repeatability, and reliability.

As downhole testing equipment gets progressively smaller to accommodate smaller boreholes and increasingly complex tools, the high pressures and temperatures of the downhole environment are pushing the limits of conventional testing apparatus. The embodiments disclosed herein overcome these deficiencies and others in the prior art.

BRIEF DESCRIPTION OF THE DRAWINGS

For a detailed description of exemplary embodiments of the invention, reference will now be made to the accompanying drawings in which.

DETAILED DESCRIPTION

Figure 1:
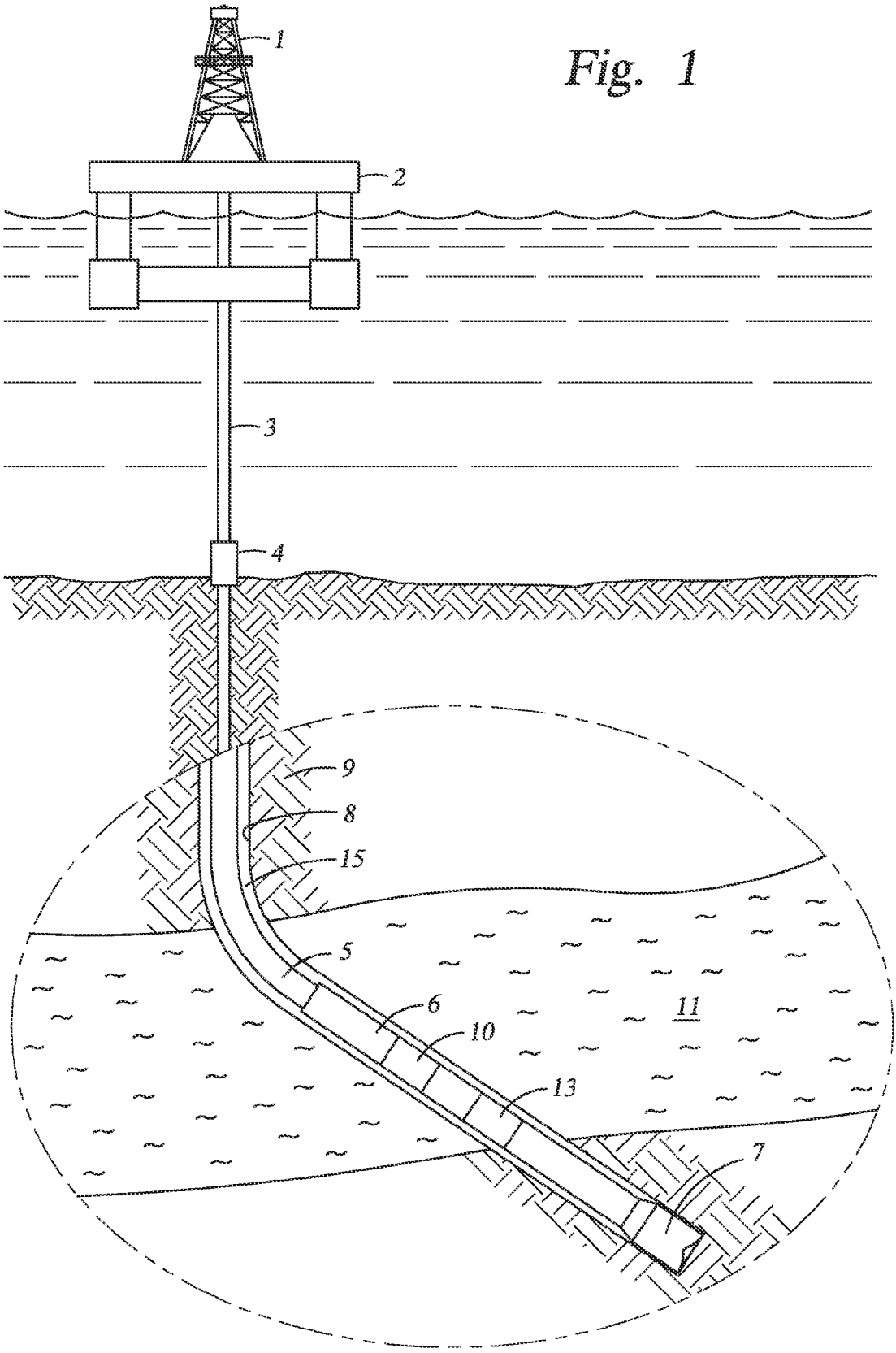
FIG. 1 is a schematic view, partly in cross-section, of a drilling apparatus with a formation tester.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results. For example, the piston accumulator embodiments have application in the field of high pressure liquid chromatography.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a drilling apparatus including a formation tester is shown. A formation tester 10 is shown enlarged and schematically as a part of a bottom hole assembly 6 including a sub 13 and a drill bit 7 at its distal most end. The bottom hole assembly 6 is lowered from a drilling platform 2, such as a ship or other conventional land platform, via a drill string 5. The drill string 5 is disposed through a riser 3 and a well head 4. Conventional drilling equipment (not shown) is supported within a derrick 1 and rotates the drill string 5 and the drill bit 7, causing the bit 7 to form a borehole 8 through formation material 9. The drill bit 7 may also be rotated using other means, such as a downhole motor. The borehole 8 penetrates subterranean zones or reservoirs, such as reservoir 11, that are believed to contain hydrocarbons in a commercially viable quantity. An annulus 15 is formed thereby. In addition to the formation tester 10, the bottom hole assembly 6 contains various conventional apparatus and systems, such as a down hole drill motor, a rotary steerable tool, a mud pulse telemetry system, MWD or LWD sensors and systems, and others known in the art.

Figure 2:
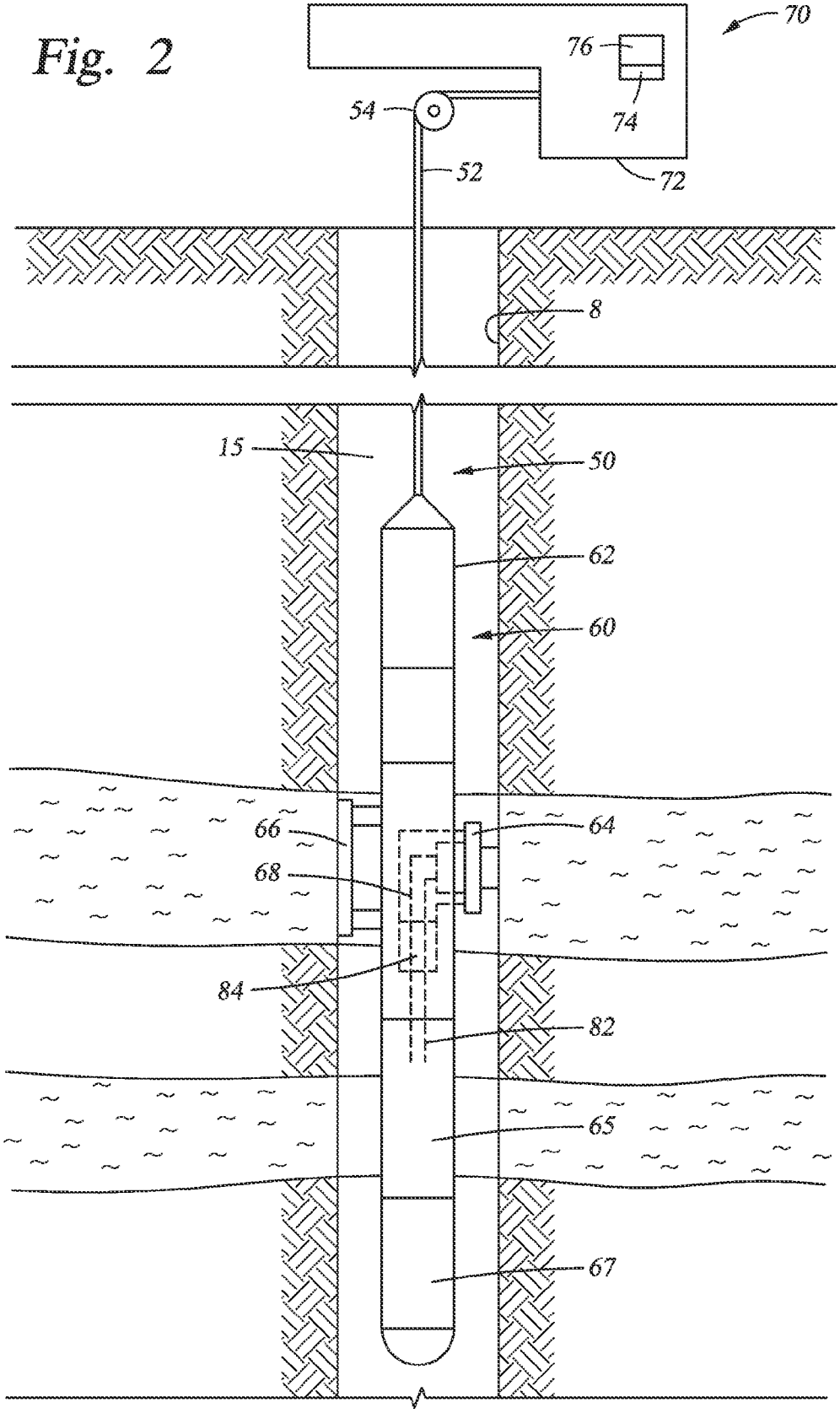
FIG. 2 is a schematic view, partly in cross-section, of a formation tester conveyed by wireline.

In some embodiments, and with reference to FIG. 2, a formation testing tool 60 is disposed on a tool string 50 conveyed into the borehole 8 by a cable 52 and a winch 54. The testing tool includes a body 62, a sampling assembly 64, a backup assembly 66, analysis modules 68, 84 including electronic devices, a flowline 82, a battery module 65, and an electronics module 67. The formation tester 60 is coupled to a surface unit 70 that may include an electrical control system 72 having an electronic storage medium 74 and a control processor 76. In other embodiments, the tool 60 may alternatively or additionally include an electrical control system, an electronic storage medium and a processor.

Figure 3:
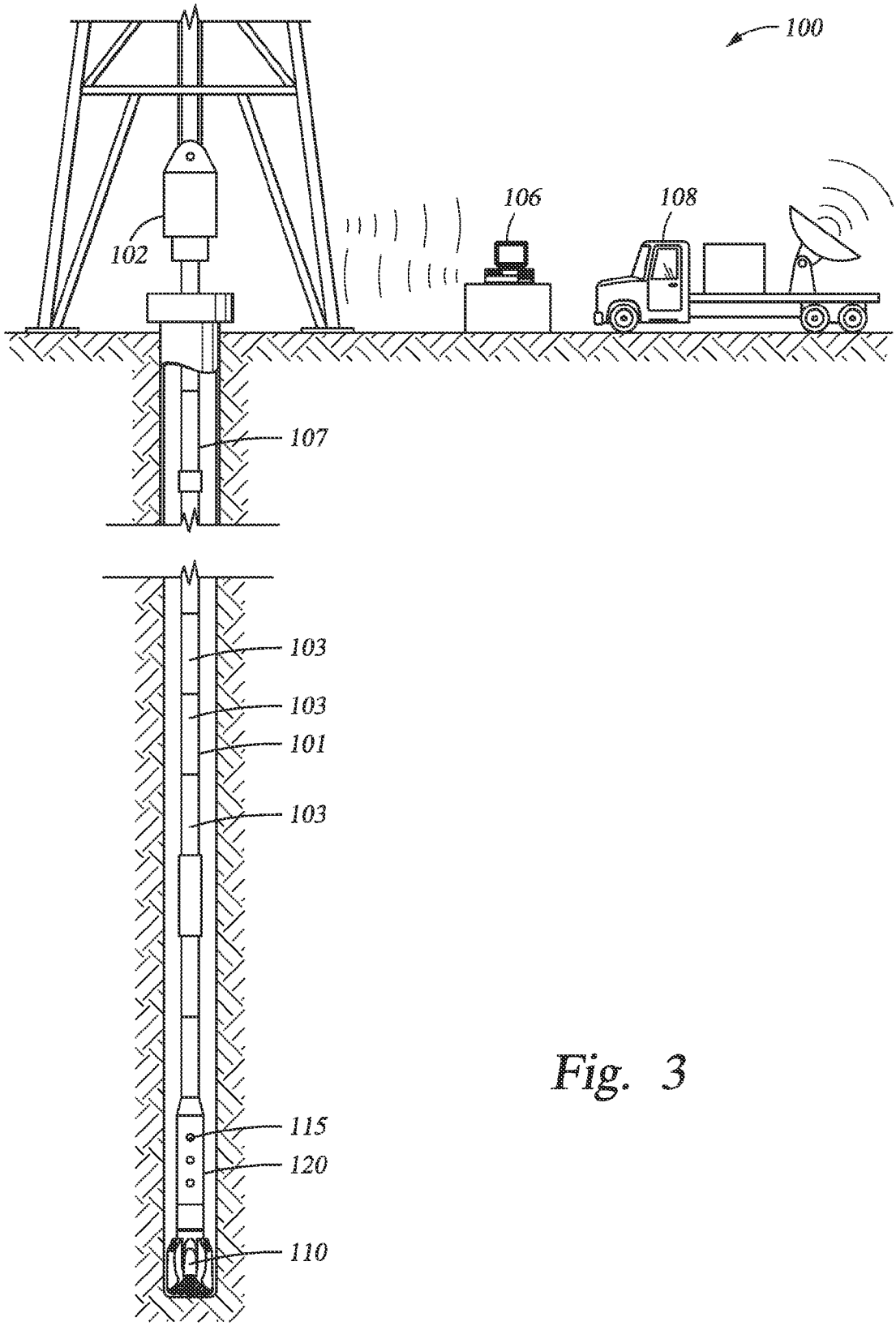
FIG. 3 is a schematic view, partly in cross-section, of a formation tester disposed on a wired drill pipe connected to a telemetry network.

Referring to FIG. 3, a telemetry network 100 is shown. A formation tester 120 is coupled to a drill string 101 formed by a series of wired drill pipes 103 connected for communication across junctions using communication elements. It will be appreciated that work string 101 can be other forms of conveyance, such as wired coiled tubing. The downhole drilling and control operations are interfaced with the rest of the world in the network 100 via a top-hole repeater unit 102, a kelly 104 or top-hole drive (or, a transition sub with two communication elements), a computer 106 in the rig control center, and an uplink 108. The computer 106 can act as a server, controlling access to network 100 transmissions, sending control and command signals downhole, and receiving and processing information sent up-hole. The software running the server can control access to the network 100 and can communicate this information via dedicated land lines, satellite uplink 108), Internet, or other means to a central server accessible from anywhere in the world. The formation tester 120 is shown linked into the network 100 just above the drill bit 110 for communication along its conductor path and along the wired drill string 101.

The formation tester 120 may include a plurality of transducers 115 disposed on the formation tester 120 to relay downhole information to the operator at surface or to a remote site. The transducers 115 may include any conventional source/sensor (e.g., pressure, temperature, gravity, etc.) to provide the operator with formation and/or borehole parameters, as well as diagnostics or position indication relating to the tool. The telemetry network 100 may combine multiple signal conveyance formats (e.g., mud pulse, fiber-optics, acoustic, EM hops, etc.). It will also be appreciated that software/firmware may be configured into the formation tester 120 and/or the network 100 (e.g., at surface, downhole, in combination, and/or remotely via wireless links tied to the network).

Figure 4:
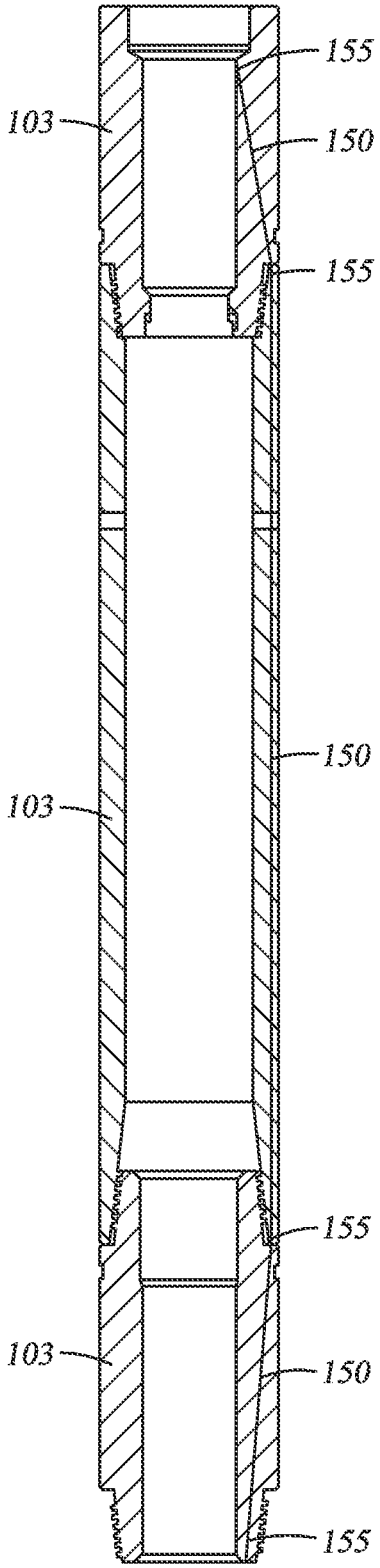
FIG. 4 is a cross-section view of a section of wired drill pipe.

Referring briefly to FIG. 4, sections of wired drill pipe 103 are enlarged for clarity. The wired drill pipe 103 includes conductors 150 that traverse the entire length of the pipe sections. Communication elements 155 allow the transfer of power and/or data between the pipe sections 103. A data/power signal may be transmitted along a pipe section of the wired drill string, such as the pipe section with formation tester 120 (FIG. 3), from one end through the conductor(s) 150 to the other end across the communication elements 155. In some embodiments, the conductor(s) 150 comprise coaxial cables, copper wires, optical fiber cables, triaxial cables, and twisted pairs of wire. The conductor(s) 150 may be disposed through a hole formed in the walls of the outer tubular members of the pipes 103. The communication elements 155 may comprise inductive couplers, direct electrical contacts, optical couplers, and combinations thereof. Portions of the wired drill pipes 103 may be subs or other connections means. The ends of subs or connections means of the wired subs 103 are configured to communicate within the downhole telemetry network 100.

Figure 5:
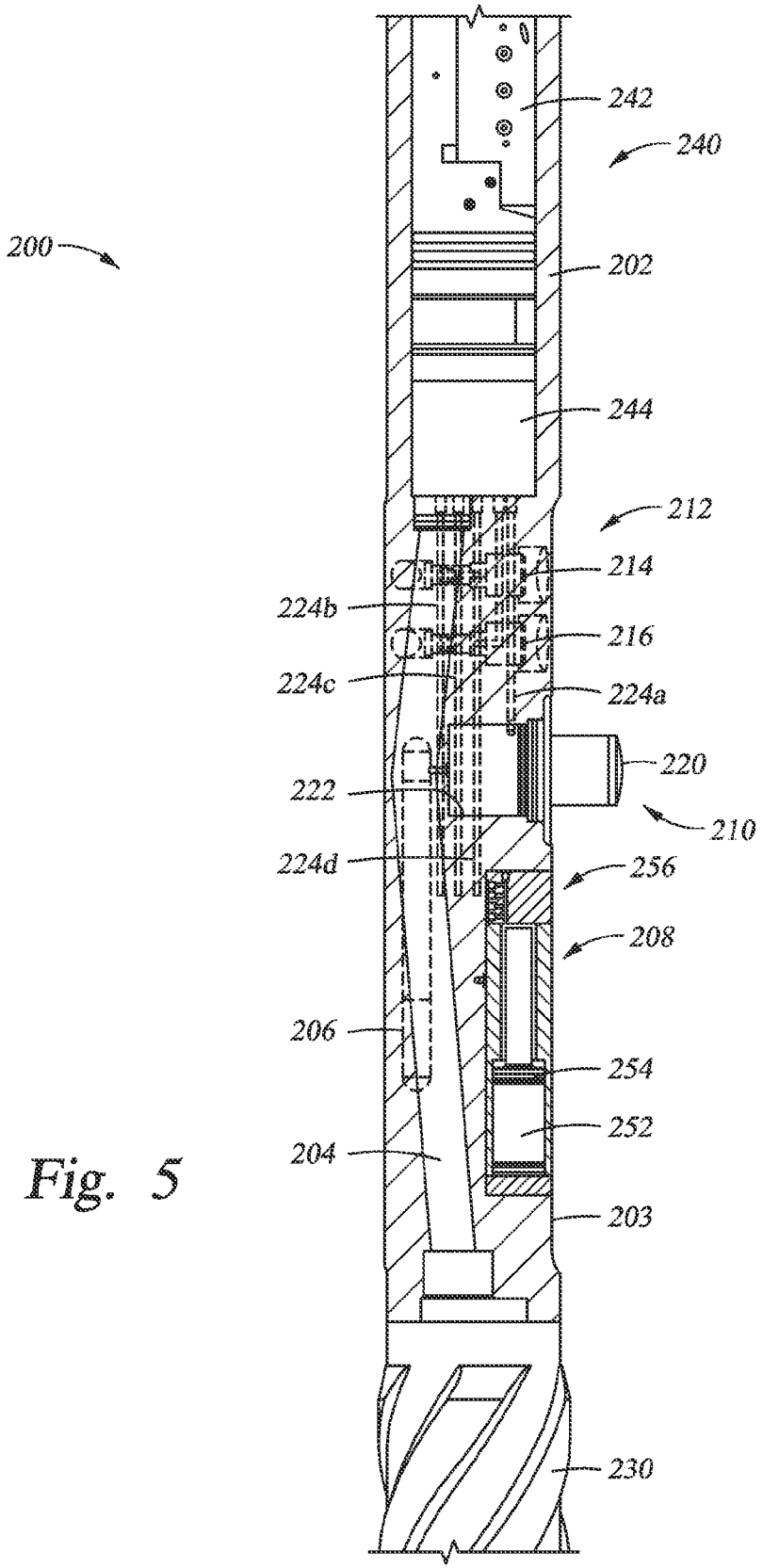
FIG. 5 is a side view, partly in cross-section, of a drill collar including a formation probe assembly.

Referring next to FIG. 5, an embodiment of an MWD formation probe collar section 200 is shown in detail, which may be used as the tool 10 in FIG. 1 or the tool 120 in FIG. 3. A drill collar 202 houses the formation tester or probe assembly 210. The probe assembly 210 includes various components for operation of the probe assembly 210 to receive and analyze formation fluids from the earth formation 9 and the reservoir 11. An extendable probe member 220 is disposed in an aperture 222 in the drill collar 202 and extendable beyond the drill collar 202 outer surface, as shown. The probe member 220 is retractable to a position recessed beneath the drill collar 202 outer surface. The probe assembly 210 may include a recessed outer portion 203 of the drill collar 202 outer surface adjacent the probe member 220. The probe assembly 210 includes a draw down or piston accumulator assembly 208, a sensor 206, a valve assembly 212 having a flow line shutoff valve 214 and equalizer valve 216, and a drilling fluid flow bore 204. At one end of the probe collar 200, generally the lower end when the tool 10 is disposed in the borehole 8, is an optional stabilizer 230, and at the other end is an assembly 240 including a hydraulic system 242 and a manifold 244.

The piston assembly 208 includes a piston chamber 252 containing a piston 254 and a manifold 256 including various fluid and electrical conduits and control devices. The piston assembly 208, the probe 220, the sensor 206 (e.g., a pressure gauge) and the valve assembly 212 communicate with each other and various other components of the probe collar 200, such as the manifold 244 and hydraulic system 242, as well as the tool 10 via conduits 224*a*, 224*b*, 224*c* and 224*d*. The conduits 224*a*, 224*b*, 224*c*, 224*d* include various fluid flow lines and electrical conduits for operation of the probe assembly 210 and probe collar 200.

Figure 6:
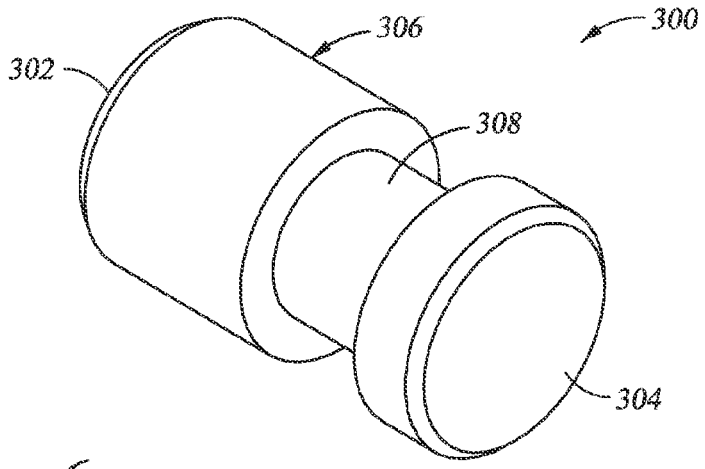
FIG. 6 is a perspective view of an embodiment of a piston of a piston accumulator system.

An embodiment of a piston accumulator assembly or system for use in the various systems described above will now be described. Referring now to FIG. 6, a piston 300 includes a first end portion 302, a second end portion 304, and an intermediate portion 306 having a seal assembly recess or o-ring groove 308. The end portion 304 may be configured to receive a hydrocarbon sample (e.g., crude oil). The second end portion 302 may be configured to receive a hydraulic fluid (e.g., water).

In exemplary embodiments, the piston 300 is nonmetallic. In further embodiments, the piston 300 is made from polytetrafluoroethylene (PTFE), or Teflon, plus fiberglass. In certain embodiments, the piston is made from a composition of Teflon plus fiberglass called Rulon. The above-mentioned materials make the piston 300 relatively "soft" compared to surrounding metallic components, as described more fully below. The Teflon plus fiberglass composite material may be adapted for systems accommodating, for example, 20,000 to 25,000 p.s.i., and a wide temperature range up to about 450° F., as is sometimes present in the downhole environment. Another exemplary operating range of the soft piston 300 is 20,000 p.s.i. and 350° F. The small diameter or low volume of the chamber in which the soft piston moves, and the high pressure application of the soft piston makes conventional systems inappropriate. The wide temperature range also complicates the working environment of the soft piston.

To further condition the soft piston 300 for operation in the environments described, the outer surface of the soft piston 300 may be polished. In further embodiments, the soft piston 300 may also be heat treated at 100-150° F., or alternatively at 350° F. Heat treating and/or polishing the soft piston 300 creates good tolerance between the soft piston 300 and the metallic cylinder or tube in which it reciprocates during use. Such treatments also optimize the sealing capability between the soft piston and the tube at widely varying temperatures, including low temperatures. In some embodiments, the piston/tube tolerance and sealing capability is customized for a preferred operating range by variously tweaking the composition of the Rulon, adjusting the amount or type of polishing, and/or adjusting the temperature of the heat treatment. Because the soft Rulon piston 300 is a thermoplastic, a desired actuating pressure of the soft piston can be achieved for a given temperature. Thus, the various characteristics of the soft piston 300 just described can be adjusted for a predetermined and/or anticipated operating range of pressure and/or temperature for the soft piston. In extreme examples of low operating temperatures, such as down to −70° F., the soft piston can be customized to include a silicone seal in the seal recess 308.

In the embodiments just described, the soft thermoplastic or Rulon piston material is mechanically robust and chemically unreactive. In these embodiments, and in the downhole environment with operating ranges described, the piston is soft relative to the surrounding tube such that damage to the soft piston is avoided, the soft piston does not cold flow, the soft piston includes a low coefficient of friction, and the soft piston includes close tolerances and sealing capabilities. These characteristics are adjustable based on the predetermined or anticipated operating ranges by manipulating the soft piston specifications described above.

Figure 7:
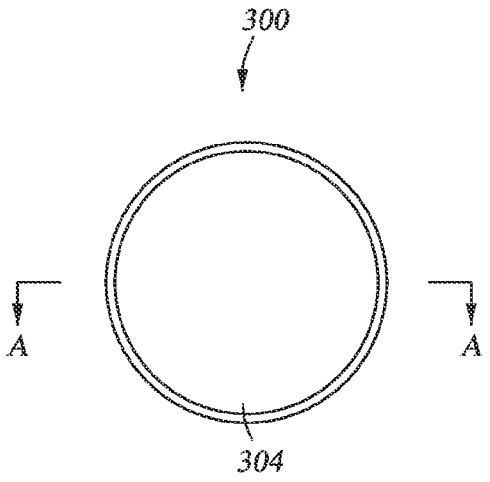
FIG. 7 is an end view of the piston of FIG. 6.
Figure 8:
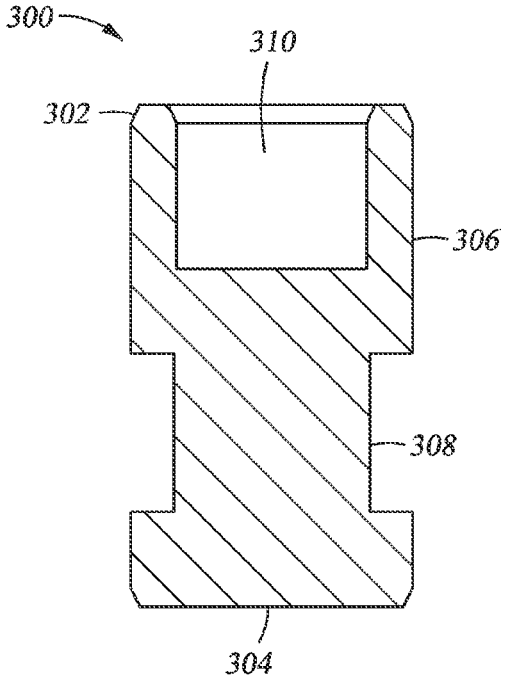
FIG. 8 is a longitudinal cross-section view of the piston of FIGS. 6 and 7.

Referring to FIGS. 7 and 8, an end view and a longitudinal cross-section view of the soft piston 300 are shown. The soft piston 300 includes a cavity 310 in the end portion 302 for receiving a magnet or other sensor device. The magnet may be secured in the cavity 310 with epoxy. The seal assembly recess 308 may receive a seal assembly that can be custom fitted to get the preferred tolerances and operating range of the piston system, as referenced above and detailed further below.

Figure 9:
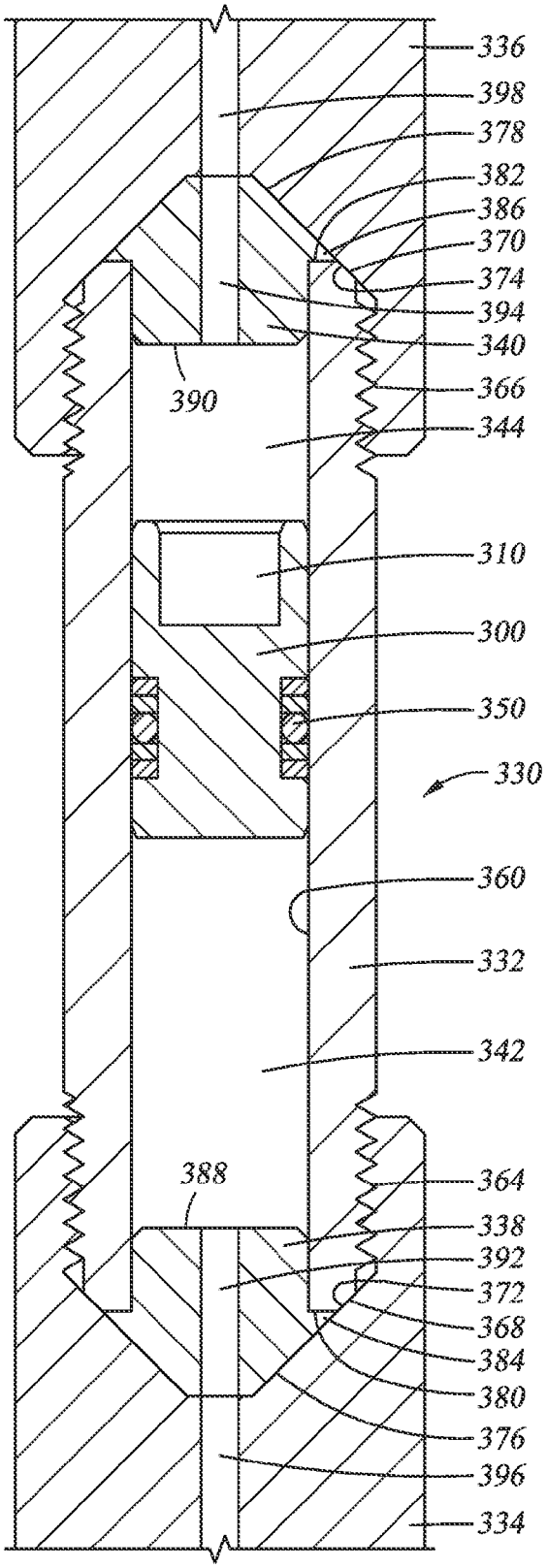
FIG. 9 is a longitudinal cross-section view of an embodiment of an assembled piston accumulator system including the piston of FIGS. 6-8.

In FIG. 9, an embodiment of an assembled piston accumulator system 330 is shown in longitudinal cross-section and including the soft piston 300. The piston accumulator system 330 includes a cylindrical housing or tube 332 captured between two end caps or couplers 334, 336. The cylinder 332 may be high pressure tubing, such as an Autoclave high pressure nipple or cylinder. The inside surface 360 of the cylinder bore may be honed and/or polished. The soft or nonmetallic piston as previously described, and engaged with the honed surface 360 of the cylinder 332, provides a desirable interaction between the piston and the cylinder.

A spacer 338 is captured between the end cap 334 and the cylinder 332 and forms a chamber 342 with the soft piston 300 (such as for hydrocarbon samples taken from the formation, e.g., crude oil). A spacer 340 is captured between the end cap 336 and the cylinder 332 and forms a chamber 344 with the soft piston 300 (such as for hydraulic fluid, e.g., water). In some embodiments, the spacers 338, 340 are made from polyether ether ketone (PEEK).

When the end caps 334, 336 are coupled with the cylinder 332 ends, such as by the threaded connections 364, 366, the inner tapered surfaces 372, 374 engage the outer tapered surfaces 368, 370 of the corresponding cylinder ends. This engagement causes a crimping between the cylinder 332 and the end caps 334, 336 resulting in undercuts, deformations, projections, or shoulders 380, 382 that are discontinuities in the inner cylinder bore 360. The spacers 338, 340 include intermediate projections or ribs 384, 386 between outer surfaces 376, 378 engaged with the end cap tapered surfaces 372, 374 and inner surfaces 388, 390 that extend into the cylinder bore 360. In some embodiments, the spacer projections 384, 386 are pre-formed onto the spacers 338, 340. In other embodiments, the spacer projections 384, 386 are formed by deformation of the spacer material into the spaces left between the crimping undercuts 380, 382 and the end caps 334, 336 when the spacers are captured between the cylinder and end caps. The projections 384, 386 are then captured between the cylinder 332 and the end caps 334, 336 in the crimping spaces.

The spacers 338, 340 also include fluid passages 392, 394 fluidicly coupled with and between the axial bore 360 of the cylinder 332 and fluid passages 396, 398 in the end caps 334, 336. Hydrocarbon samples and hydraulic fluid can communicate through these fluid passages. When the piston accumulator system 330 and the cylinder 332 are coupled into a formation tester, such as formation testers 10, 60, 120, 200, these fluid passages communicate with inputs to the cylinder 332 that are connected to a network of one or more pipes and valves that permit fluid to enter and prevent fluid from leaving the cylinder 332. The network of pipes and valves are part of the formation tester necessary for transporting fluids for analysis.

The spacers 338, 340 are captured by and do not move relative to the cylinder 332 and the end caps 334, 336. The spacers 338, 340 provide fitment between the cylinder 332 and the end caps 334, 336. The spacers 338, 340 provide tolerance or space filling between the end cap/cylinder coupling and the soft piston 300, such that the soft piston stroke is between the inner spacer surfaces 388, 390 and the soft piston avoids contact with the crimping undercuts 380, 382.

Figure 9A:
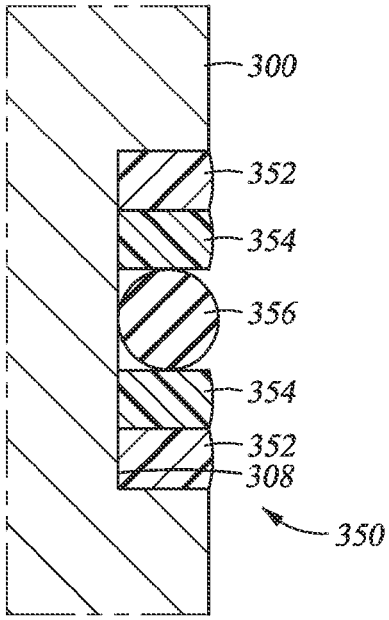
FIG. 9A is an enlarged view of the seal assembly of the piston of FIG. 9.

FIG. 9A illustrates an enlarged portion of the soft piston 300 including the seal assembly 350 disposed in the piston seal recess 308. The seal assembly 350 includes a blend of components to achieve sealing between the soft piston 300 and the cylinder bore surface 360 for the desired operating ranges of pressure and temperature. For example, the seal assembly 350 includes upper and lower, or outer, sealing components 352, intermediate sealing components 354, and a center sealing component 356. In exemplary embodiments, the outer sealing components 352 are rigid, nonmetallic members and the inner components 354, 356 are more pliable, nonmetallic members. In certain embodiments, the outer sealing components 352 are made from PEEK. The intermediate sealing components 354 may be made from Teflon or comprise Teflon Z-cut rings. The center or primary sealing component 356 may comprise a Viton o-ring or an o-ring made from a fluoroelastomer based on an alternating copolymer of tetrafluoroethylene and propylene (TFE/P), also known as AFLAS® or Fluoraz®. In descending order of rigid to pliable, the aforementioned materials are ordered: PEEK, Teflon, and the group comprising fluoroelastomer, TFE/P, Viton, and AFLAS® or Fluoraz®. The sealing components can be arranged in various combinations to achieve rigid outer components and relatively more pliable inner component(s).

The seal assembly 350 maintains a dynamic seal for the moveable soft piston 300 throughout wide ranges of pressure (for example, from ambient to 20,000 to 25,000 p.s.i.) and temperature (for example, from ambient to 400 to 450° F.) created in the downhole environment. During the pressure and temperature cycle from ambient to the above-noted pressures and temperatures, and back to ambient, the seal assembly 350 as well as the soft piston 300 maintain operability and seal integrity while also preserving the high pressure formation sample received by the accumulator system. The soft piston materials help to maintain a close tolerance of the piston with the metallic cylinder over the pressure-temperature cycle, while also providing additional functionality such as resistance to heat with continuous service temperature capability of greater than 400° F., resistance to strong acids, bases, and other downhole chemicals, resistance to oil, high electrical resistivity, positive pressure sealing at the piston faces, reduced damage to the inner cylinder surface, and piston "self healing" from embedded solid phase particles.

During the same pressure-temperature cycle, the seal assembly 350 employs multiple components to ensure seal integrity. The center, most pliable sealing component 356 provides the primary seal between the piston 300 and the inner surface 360 of the cylinder 332. As pressure and temperature increase, the sealing component 356 tends to deform undesirably. A first set of sealing components 354 is provided adjacent the sealing component 356 to back up the sealing component 356 against deformation. The sealing components, as described above, are more rigid than the sealing component 356 to ensure proper support. As pressure and temperature continue to increase, the sealing components undergo additional undesirable deformation. A second set of backup rings is provided as sealing components 352, which are more rigid than the sealing component 356 and the sealing components 354 to ensure proper support. Thus, the seal assembly 350 accommodates sealing the piston 300 under increased pressures and temperatures by backing up the center sealing component 356 with the sealing components 354, 352 having increasing rigidity and varying component materials.

In further embodiments, the soft piston 300 and seal assembly 350 are constrained in a small volume accumulator system, such as for formation testers in small diameter tool strings and existing formation tester flow lines. Nonetheless, the soft piston 300 accommodates the large pressure-temperature cycle as described above while the seal assembly 350 maintains sealing integrity with the pliable inner sealing component and at least one set of outer rigid sealing components.

Figure 10:
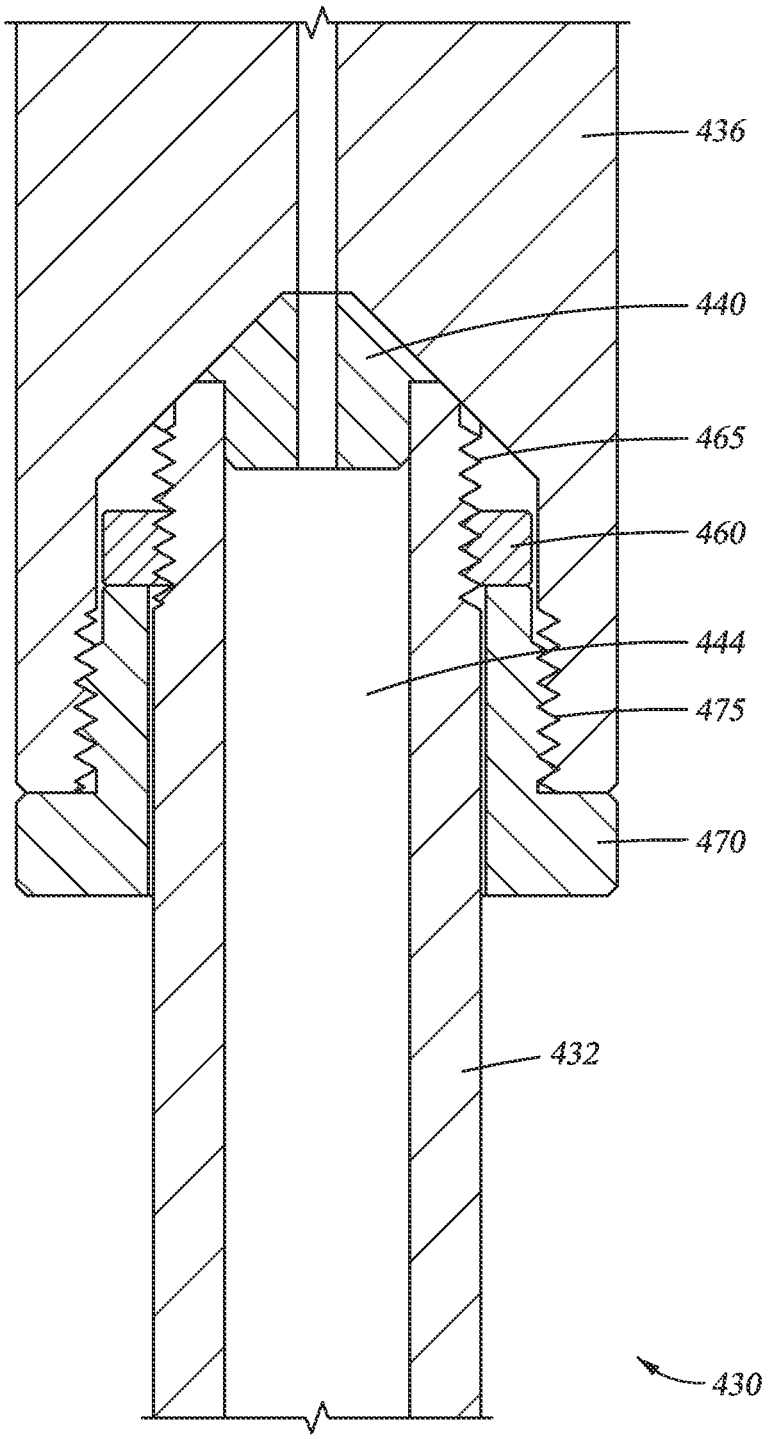
FIG. 10 is a cross-section view of an alternative coupling between the piston tube and the end coupler to capture the spacer, in another piston accumulator system.

Turning to FIG. 10, an alternative embodiment of an assembled end of a piston accumulator system 430 is shown in longitudinal cross-section. The piston accumulator system 430 includes a cylindrical tube or nipple 432 captured connected to an end cap or coupler 436. A spacer 440 is captured between the end cap 436 and the cylinder 432 and forms a chamber 444 with the soft piston (not shown). To properly engage the tapered surfaces of the nipple 432, the coupler 436, and the spacer 440, as shown and previously described, a gland and nut system is provided. More specifically, a gland 460 threadably engages a left hand threaded portion 465 of the outer surface of the nipple 432. A nut 470 threadably engages a right hand threaded portion 475 of the inner surface of the nipple coupler 436. As the gland and nut system is secured, the inner tapered surfaces of the coupler 436 engaged the outer tapered surfaces of the nipple 432 and the spacer 440 as shown in FIG. 10. This engagement causes a crimping between the nipple and the coupler resulting in undercuts, deformations, projections, or shoulders that are discontinuities in the inner cylinder bore. As previously described, the spacer include a portion that fills the undercut or discontinuity. The spacer 440 is captured by and does not move relative to the cylinder 432 and the coupler 436. The spacer 440 provides fitment between the cylinder and the coupler. The spacer 440 provides tolerance or space filling between the end cap/cylinder coupling and the soft piston, such that the piston stroke is between the inner spacer surfaces and the soft piston avoids contact with the crimping undercuts.

The piston accumulator embodiments described herein provide a system adapted for high pressure downhole fluids, for optical fluid identification as well as other fluid analyses. The piston accumulator system includes better resistance to harsh and wide operating ranges of pressure and temperature in small diameter and small volume applications, through various combinations of the soft piston design characteristics, the seal assembly design characteristics, the honed and polished cylinder bore, and the spacers in the cylinder. The soft piston member maintains structural and sealing integrity with the surrounding metal cylinder, at least because the material makeup of the soft piston results in close tolerances and sealing capabilities, resistance to cold flow, a low coefficient of friction, reduced damage from and to the metal cylinder, resistance to heat and chemicals, and piston "self healing" from embedded solid phase particles. The soft piston materials also allow sizing down of the piston for use in small diameter or low volume cylinders while also accommodating the described pressure-temperature cycle. A sized down soft piston and accumulator system can be connected into an existing flow line of a formation tester without increasing the inner diameter of the flow line. Additionally, the sealing capabilities of the soft piston are enhanced by the multi-component seal assembly including a primary, pliable sealing member and one or more sets of more rigid backup sealing components. Finally, the adaptabability of the soft piston to varying operating pressures and temperatures is also increased with a piston accumulator system including a honed and polished bore, and spacers that define a stroke that avoids bore undercuts or discontinuities between the cylinder and the end caps.

Based on these various characteristics, the soft piston member and the piston accumulator embodiments are adaptable for use in wireline, reservoir description tools (RDT), drill stem testing (DST), MWD formation testing, and high pressure liquid chromatography. In very harsh and dynamic environments, the system allows physical pressure-volume-temperature (PVT) analysis downhole. Further, the system allows micro-PVT, i.e., PVT with smaller samples resulting in less waste. Still further, smaller sample volumes leads to smaller tool cross-sections, in turn resulting in accessibility to more formation zones and narrower holes, as well as reduced sticking of the drill or work string.

A piston accumulator system with one or more of the above characteristics or capabilities may include a cylindrical housing with an axial bore extending between end portions of the housing, a soft piston slidably disposed in the axial bore, an end cap coupled to each end portion of the cylindrical housing to contain the soft piston in the axial bore, and a seal assembly disposed between the soft piston and the axial bore, the seal assembly comprising rigid outer components and a pliable inner component. The soft piston may be nonmetallic, or include PTFE plus fiberglass, Rulon, or a combination thereof. The soft piston is operable during a pressure-temperature cycle including ambient to 25,000 p.s.i. and ambient to 450° F. In some embodiments, the soft piston is captured in a small volume of the capped cylindrical housing such that the system is connectable into an existing flow line of a formation tester. In certain embodiments, the soft piston includes a polish treatment wherein the polish treatment is adjustable based on a predetermined operating pressure or temperature of the soft piston. In further embodiments, the soft piston includes a heat treatment wherein the heat treatment is adjustable based on a predetermined operating pressure or temperature of the soft piston.

To further enhance the pressure-temperature cycle resistance capabilities of the piston accumulator system, the seal assembly may include a pair of rigid outer sealing components, a pair of pliable intermediate sealing components, and a pliable center sealing component, wherein the pliable intermediate sealing components are more pliable than the rigid outer sealing components, and the pliable center sealing component is more pliable than the rigid outer sealing components and the pliable intermediate sealing components. In some embodiments, the rigid outer sealing components comprise PEEK, the pliable intermediate sealing components comprise Teflon, and the pliable center sealing component comprises at least one of a fluoroelastomer, TFE/P, Viton, AFLAS® and Fluoraz®.

To reduce discontinuities and ensure a smooth piston stroke in the cylinder bore, the piston accumulator system may include a spacer captured between each end cap and each housing end portion, wherein each end cap includes an inner tapered surface engaged with an outer tapered surface of the housing end portions, and wherein an outer tapered surface of the spacers engage the inner tapered surfaces of the end caps. In some embodiments, the spacers include an outer surface engaged with the end caps, an inner surface, and an intermediate portion including a projection captured between the housing end surface and the end cap to file an undercut formed between housing and the end caps. The spacers may be nonmetallic and include materials disclosed herein to properly accommodate the pressure-temperature cycle. Further, the spacers may include a fluid passage fluidicly coupled between the axial bore of the housing and fluid passages in the end caps, wherein the fluid passages communicate with a network of one or more pipes and valves that permit fluid to enter and prevent fluid from leaving the cylinder bore.

In one embodiment, the piston accumulator system includes a cylindrical housing with an axial bore extending between end portions of the housing, a soft piston slidably disposed in the axial bore, wherein the soft piston comprises at least one of PTFE plus fiberglass and Rulon, a seal assembly disposed between the soft piston and the axial bore, the seal assembly comprising rigid outer components and a pliable inner component, an end cap coupled to each end portion of the cylindrical housing to contain the soft piston in the axial bore, and a spacer captured between each end cap and each housing end portion.

Figure 11:
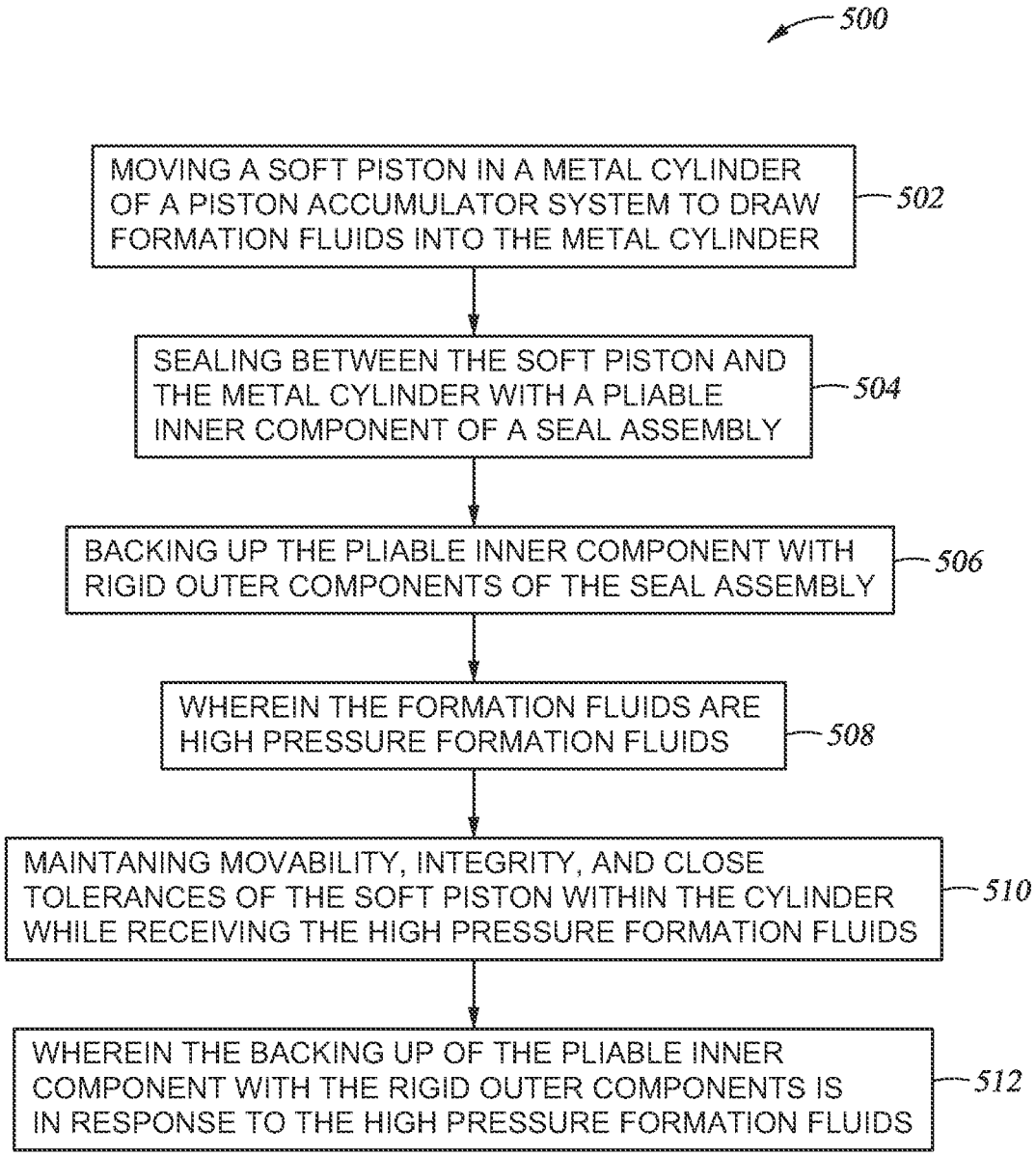
FIG. 11 is a flow chart of a method for accumulating formation fluids downhole during a large pressure-temperature cycle using embodiments of the piston accumulator system.

Now with reference to FIG. 11, a method (500) for accumulating formation fluids downhole during a large pressure-temperature cycle includes moving a soft piston in an axial bore of a metal cylindrical housing to draw formation fluids into the bore (502), sealing between the soft piston and the bore of the metal housing with a pliable inner component of a seal assembly (504), and backing up the pliable inner component with rigid outer components of the seal assembly (506). In some embodiments of the method, the formation fluids may be high pressure formation fluids (508), and the method may further include maintaining movability, integrity, and close tolerances of the soft piston within the bore of the metal housing while receiving the high pressure formation fluids (510). The high pressure formation fluids may include a pressure up to 25,000 p.s.i., and a temperature up to 450° F. In certain embodiments of the method, the backing up of the pliable inner component with the rigid outer components is in response to the high pressure formation fluids (512).

Figure 12:
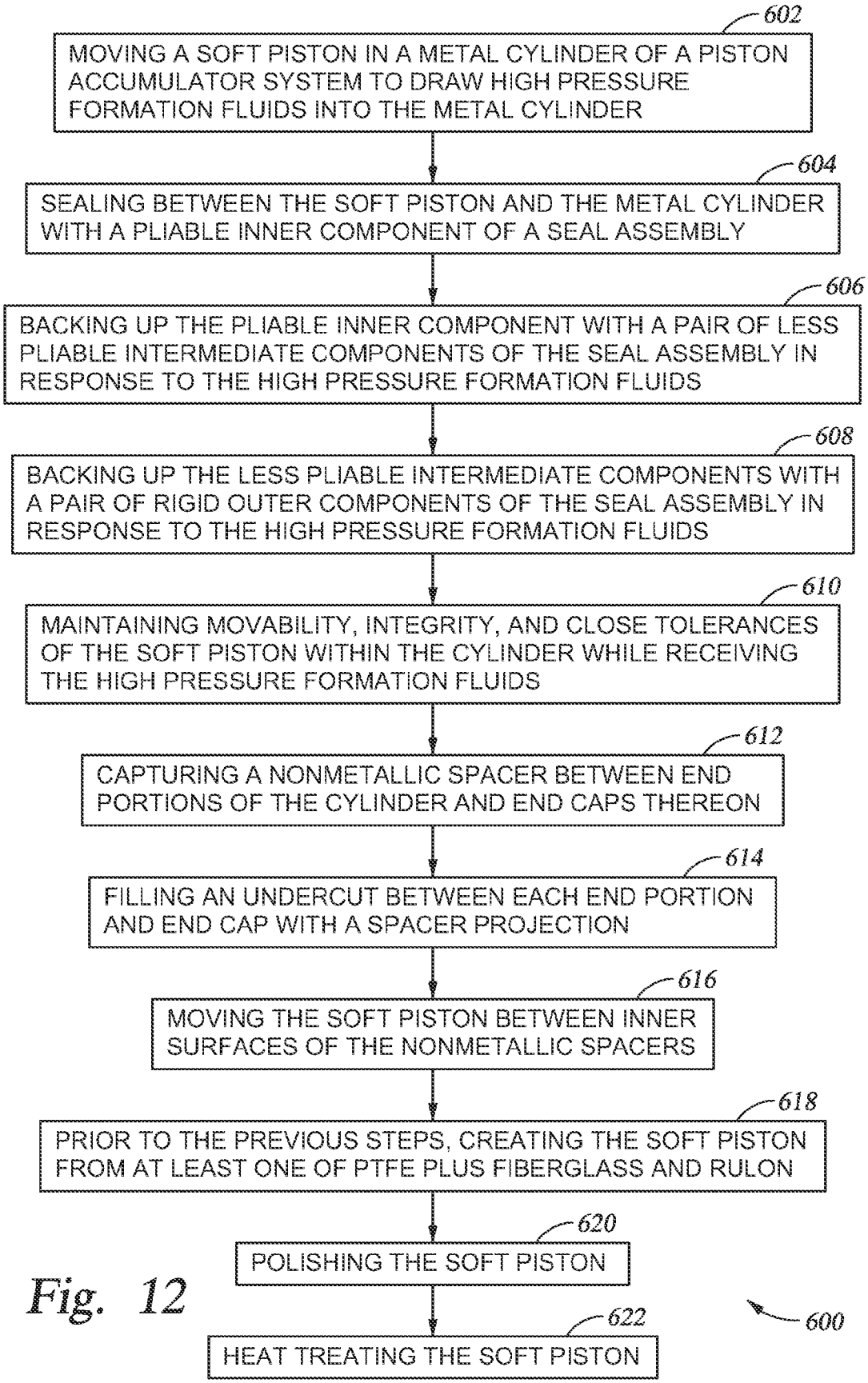
FIG. 12 is a flow chart of another method for accumulating formation fluids downhole during a large pressure-temperature cycle using embodiments of the piston accumulator system.

Next with reference to FIG. 12, another method (600) for accumulating formation fluids downhole during a large pressure-temperature cycle includes moving a soft piston in an axial bore of a metal cylindrical housing to draw high pressure formation fluids into the bore (602), sealing between the soft piston and the bore of the metal housing with a pliable inner component of a seal assembly (604), backing up the pliable inner component with a pair of less pliable intermediate components of the seal assembly in response to the high pressure formation fluids (606), and backing up the less pliable intermediate components with a pair of rigid outer components of the seal assembly in response to the high pressure formation fluids (608). The soft piston and the sealing components may include the materials as described herein. The soft piston resists the high pressure formation fluids to maintain movability, integrity, and close tolerances of the soft piston within the bore of the metal housing while receiving the high pressure formation fluids (610). In additional embodiments, the method includes capturing a nonmetallic spacer between end portions of the cylindrical metal housing and end caps thereon (612), filling an undercut between each end portion and end cap with a spacer projection (614), and moving the soft piston between inner surfaces of the nonmetallic spacers (616). In some embodiments, prior to the previous steps, the method includes creating the soft piston from at least one of PTFE plus fiberglass and Rulon (618), polishing the soft piston (620), and heat treating the soft piston (622).

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures hereafter thought of, and because many modifications may be made in the embodiments herein detailed in accordance with the descriptive requirements of the law, it is to be understood that the details herein are to be interpreted as illustrative and not in a limiting sense. For example, the piston accumulator embodiments have application in the field of high pressure liquid chromatography.

What is claimed is:

1. A piston accumulator system comprising:

a cylindrical housing with an axial bore extending between end portions of the housing;

a soft piston slidably disposed in the axial bore;

an end cap coupled to each end portion of the cylindrical housing to contain the soft piston in the axial bore; and a seal assembly disposed between the soft piston and the axial bore, the seal assembly comprising rigid outer components and a pliable inner component.

2. The piston accumulator system of claim 1 wherein the soft piston comprises at least one of polytetrafluoroethylene plus fiberglass and Rulon.

3. The piston accumulator system of claim 1 wherein the soft piston is operable during a pressure-temperature cycle including ambient to 25,000 p.s.i. and ambient to 450° F.

4. The piston accumulator system of claim 1 wherein the soft piston is captured in a small volume of the capped cylindrical housing such that the system is connectable into an existing flow line of a formation tester.

5. The piston accumulator system of claim 1 wherein the seal assembly includes a pair of rigid outer sealing components, a pair of pliable intermediate sealing components, and a pliable center sealing component, wherein the pliable intermediate sealing components are more pliable than the rigid outer sealing components, and the pliable center sealing component is more pliable than the rigid outer sealing components and the pliable intermediate sealing components.

6. The piston accumulator system of claim 5 wherein the rigid outer sealing components comprise polyester ether ketone, the pliable intermediate sealing components comprise Teflon, and the pliable center sealing component comprises at least one of a fluoroelastomer, tetrafluoroethylene-propylene Viton, AFLAS® and Fluoraz®.

7. The piston accumulator system of claim 1 further comprising a spacer captured between each end cap and each housing end portion.

8. The piston accumulator system of claim 7 wherein each end cap includes an inner tapered surface engaged with an outer tapered surface of the housing end portions.

9. The piston accumulator system of claim 8 wherein an outer tapered surface of the spacers engage the inner tapered surfaces of the end caps.

10. The piston accumulator system of claim 7 wherein the spacers include an outer surface engaged with the end caps, an inner surface, and an intermediate portion including a projection captured between the housing end surface and the end cap.

11. The piston accumulator system of claim 10 wherein the spacer inner surfaces extend into the axial bore of the cylindrical housing.

12. The piston accumulator system of claim 7 wherein the spacers include a fluid passage fluidicly coupled between the axial bore of the housing and fluid passages in the end caps, and wherein the fluid passages communicate with a network of one or more pipes and valves that permit fluid to enter and prevent fluid from leaving the cylinder bore.

13. The piston accumulator system of claim 1 wherein the soft piston includes a cavity to receive a sensor target member.

14. A piston accumulator system comprising:

a metal cylindrical housing with an axial bore extending between end portions of the housing;

a soft piston slidably disposed in the axial bore, wherein the soft piston comprises at least one of polytetrafluoroethylene plus fiberglass and Rulon;

a seal assembly disposed between the soft piston and the axial bore, the seal assembly comprising rigid outer components and a pliable inner component;

an end cap coupled to each end portion of the cylindrical housing to contain the soft piston in the axial bore;

a spacer captured between each end cap and each housing end portion.

15. A method for accumulating downhole formation fluids comprising:

moving a soft piston in an axial bore of a metal cylindrical housing between end caps of the metal cylindrical housing, to draw formation fluids into the bore;

sealing between the soft piston and the metal cylindrical housing bore with a pliable inner component of a seal assembly; and backing up the pliable inner component with rigid outer components of the seal assembly.

16. The method of claim 15 wherein the formation fluids are high pressure formation fluids, and further comprising maintaining movability of the soft piston within the bore of the metal housing while receiving the high pressure formation fluids.

17. The method of claim 16 wherein the high pressure formation fluids include a pressure up to 25,000 p.s.i., and a temperature up to 450° F.

18. The method of claim 16 further comprising backing up the pliable inner component with a pair of less pliable intermediate components in response to the high pressure formation fluids, and backing up the less pliable intermediate components with a pair of rigid outer components of the seal assembly in response to the high pressure formation fluids.

19. The method of claim 15 further comprising:

capturing a nonmetallic spacer between end portions of the cylindrical metal housing and end caps thereon;

filling an undercut between each end portion and end cap with a spacer projection; and moving the soft piston between inner surfaces of the nonmetallic spacers.

20. The method of claim 15 further comprising, prior to the previous steps:

creating the soft piston from at least one of polytetrafluoroethylene plus fiberglass and Rulon;

polishing the soft piston; and heat treating the soft piston.

* * * * *